US009550282B2

(12) United States Patent
Davis

(10) Patent No.: US 9,550,282 B2
(45) Date of Patent: Jan. 24, 2017

(54) COMPACT HYDRAULIC TORQUE WRENCH CARTRIDGE

(71) Applicant: John D. Davis, Las Vegas, NV (US)

(72) Inventor: John D. Davis, Las Vegas, NV (US)

( * ) Notice: Subject to any disclaimer, the term of this patent is extended or adjusted under 35 U.S.C. 154(b) by 266 days.

(21) Appl. No.: 14/258,344

(22) Filed: Apr. 22, 2014

(65) Prior Publication Data

US 2015/0298301 A1 Oct. 22, 2015

(51) Int. Cl.
*B25B 21/00* (2006.01)

(52) U.S. Cl.
CPC ..... *B25B 21/005* (2013.01)

(58) Field of Classification Search
CPC ..... B25B 21/004; B25B 21/005; F15B 15/061
USPC ..... 81/57.39
See application file for complete search history.

(56) References Cited

U.S. PATENT DOCUMENTS 4,409,865 A * 10/1983 Krautter ..... B25B 21/005 74/143
4,429,597 A * 2/1984 Grabovac ..... B25B 23/0078 81/57.39
4,513,645 A * 4/1985 Grabovac ..... B25B 21/005 81/57.39
4,607,546 A * 8/1986 Wagner ..... B25B 23/0078 81/57.39
4,619,160 A * 10/1986 Meyer ..... B25B 21/005 81/57.39
4,644,829 A * 2/1987 Junkers ..... B25B 13/463 81/57.39
4,663,997 A * 5/1987 Junkers ..... B25B 13/463 81/57.3
4,669,338 A * 6/1987 Collins ..... B25B 13/462 81/57.39
4,671,142 A * 6/1987 Junkers ..... B25B 13/463 81/57.39
4,674,368 A * 6/1987 Surowiecki ..... B25B 23/0078 81/57.39
4,706,527 A * 11/1987 Junkers ..... B25B 21/005 81/57.39
4,709,600 A * 12/1987 Mierbach ..... B25B 21/005 81/57.39
4,744,271 A * 5/1988 Collins ..... B25B 13/462 81/57.39
4,748,873 A * 6/1988 Snyder ..... B25B 21/005 81/57.39
4,765,210 A * 8/1988 Mierbach ..... B25B 21/005 81/57.39
4,794,825 A * 1/1989 Schmoyer ..... B25B 23/0078 81/57.24

(Continued)

*Primary Examiner* — David B Thomas
(74) *Attorney, Agent, or Firm* — IDEPA Inc.

(57) ABSTRACT

Drive plates of a hydraulic torque wrench cartridge are thickened for extended surface contact with three pawls and a direct contact with the piston rod. The drive plates are held together and are additionally stiffened by dowel pins and shoulder screws. Snap pins are axially slide able and spring loaded connecting the piston rod with the drive plates in an easily disengage able fashion. Three pawls are arrayed in a pitch adjusted with respect to the ratchet teeth pitch in correspondence with an elastic deformation of the drive plates for a balanced force transfer across them. The pawl-tooth interfaces are also in an outward opening angle preventing them from snapping free under load.

5 Claims, 8 Drawing Sheets

(56) References Cited

U.S. PATENT DOCUMENTS 4,825,730 A * 5/1989 Junkers ..... B25B 21/005 81/57.36
4,846,028 A * 7/1989 Junkers ..... B25B 23/0078 81/55
4,854,197 A * 8/1989 Walton ..... B25B 21/005 81/57.39
4,982,626 A * 1/1991 More ..... B25B 21/005 81/57.39
5,003,847 A * 4/1991 Wagner ..... B25B 21/00 81/57.39
5,005,447 A * 4/1991 Junkers ..... B25B 21/005 81/57.39
5,029,497 A * 7/1991 Junkers ..... B25B 21/005 81/57.39
5,095,780 A * 3/1992 Beuke ..... B25B 21/005 81/57.39
5,097,730 A * 3/1992 Bernard ..... B25B 21/005 81/57.39
5,103,696 A * 4/1992 Beuke ..... B25B 21/005 81/57.39
5,203,238 A * 4/1993 Ferguson ..... B25B 21/005 81/57.39
5,263,388 A * 11/1993 Beuke ..... B25B 21/005 81/57.39
5,301,574 A * 4/1994 Knopp ..... B25B 23/0078 81/57.24
5,515,753 A * 5/1996 Wagner ..... B25B 21/005 81/57.39
6,068,068 A * 5/2000 Turoff ..... B25B 23/0078 173/218
6,223,836 B1 * 5/2001 Turoff ..... B25B 21/005 173/218
6,260,444 B1 * 7/2001 Junkers ..... B25B 21/005 81/57.13
6,298,752 B1 * 10/2001 Junkers ..... B25B 21/005 81/57.39
6,802,235 B2 * 10/2004 Junkers ..... B25B 21/005 81/57.39
6,912,933 B2 * 7/2005 Knopp ..... B23D 29/005 81/57.39
7,062,993 B2 * 6/2006 Shaw ..... B25B 21/005 81/54
7,082,858 B2 * 8/2006 Knopp ..... B23D 29/005 81/57.33
7,146,880 B1 * 12/2006 Francis ..... B25B 21/005 81/57.39
7,168,341 B2 * 1/2007 More ..... B25B 21/005 81/57.39
RE40,807 E * 6/2009 Kovacs ..... B25B 23/0078 173/218
7,765,895 B2 * 8/2010 Junkers ..... B25B 23/0078 81/473
8,056,426 B2 * 11/2011 Hohmann ..... B25B 21/005 73/862.23
8,650,990 B2 * 2/2014 Riestra ..... B25B 21/005 81/55
2001/0032528 A1 * 10/2001 Junkers ..... B25B 21/005 81/57.39
2002/0073808 A1 * 6/2002 Jamra ..... B25B 21/005 81/57.39
2002/0121161 A1 * 9/2002 Koppenhoefer ..... B25B 21/005 81/57.39
2003/0126956 A1 * 7/2003 Junkers ..... B25B 21/005 81/57.39
2004/0060397 A1 * 4/2004 More ..... B25B 21/005 81/57.39
2004/0200320 A1 * 10/2004 Knopp ..... B23D 29/005 81/57.39
2005/0011313 A1 * 1/2005 Spirer ..... B25B 23/0078 81/57.39
2005/0166716 A1 * 8/2005 Koppenhoefer ..... B25B 21/005 81/57.39
2011/0203419 A1 * 8/2011 Riestra ..... B25B 21/005 81/57.39
2011/0314972 A1 * 12/2011 Rickley, III ..... B25B 21/005 81/57.39
2014/0238203 A1 * 8/2014 Spirer ..... B25B 21/005 81/57.39

* cited by examiner

COMPACT HYDRAULIC TORQUE WRENCH CARTRIDGE

CROSS REFERENCE

The present application cross references the concurrently filed U.S. patent application of the same Inventor titled "Hydraulic Torque Wrench with Automatic Hold Pawl" Ser. No. 14/258,400, which is hereby incorporated by reference.

FIELD OF INVENTION

The present invention relates to hydraulic torque wrenches utilizing a ratchet cartridge.

BACKGROUND OF INVENTION

Hydraulic torque wrenches are well known power tools for tightening and loosening nuts and bolts. A hydraulic pump commonly pressurizes a hydraulic fluid that is circulated to and from the hydraulic torque wrench via hoses. The hydraulic torque wrench itself commonly features a piston that transforms the fluid pressure into a piston force, which in turn is transferred via a piston rod onto drive plates, and via one or two pawls onto a ratchet wheel that is sandwiched between the drive plates. The ratchet wheel commonly connects to a nut or itself has an internal cutout that matches the nut or bolt head to be tightened or loosened.

Since nuts and bolts are commonly tightly assembled, it is desirable to have a hydraulic torque wrench as compact as possible while at the same time providing a maximum torque and reliable and lasting functionality. The weakest link in the force transmission path from the hydraulic piston to the ratchet wheel is/are commonly the pawl(s) that has/have to reliably engage with a corresponding tooth of the ratchet wheel. Ratchet wheel and pawl(s) are assembled in a cartridge between two lateral plates as is well known in the art. During return travel of the hydraulic piston, the pawl(s) has/have to disengage with the ratchet wheel. Since the pawl(s) is/are much closer positioned to the torque transfer axis than the commonly more peripheral piston rod—drive plate interface, the actual force transmitted across the pawl(s) is in accordance with the well known lever principle substantially higher than the actually produced piston force. Excessive wear commonly occurs in the plate-pawl and pawl-tooth interfaces. Therefore, there exists a need for improved plate-pawl and pawl-tooth interfaces. The present invention addresses this need.

Two cartridge pawls have been employed in the prior art to divide the force to be transmitted onto the ratchet wheel. Nevertheless, it has been discovered by the Applicant that deformation during power strokes causes displacement of the pawls resulting in uneven loads and contact pressures. The present invention addresses this discovery for balanced load and contact pressures in all plate-pawl and pawl-tooth interfaces providing for up to three cartridge pawls to be employed simultaneously.

Ratchet cartridges need to be conveniently replaced especially in cases where the ratchet wheel itself connects to the nut and/or bolt head to be tightened and loosened. Nevertheless, in the prior art commonly the piston rod had to be taken apart in order to remove the ratchet cartridge from the overall torque wrench housing. Therefore, there exists a need for a simple and reliable connection between ratchet cartridge and piston rod that can be fast and easily disconnected and reconnected. The present invention addresses also this need.

SUMMARY

A ratchet cartridge features drive plates that have castles extending within the width of the ratchet wheel. The drive plates are held together and are additionally stiffened by dowel pins and shoulder screws. The castles provide for plate-pawl interfaces that extend across the entire width of the cartridge pawls, which substantially reduces contact pressures and affiliated wear in the plate-pawl interfaces.

The rod-plate interface is includes a rod push face at the distal end of the piston rod pushing directly onto a rod receive face within the drive plate castles. The region around the rod-plate interface axis is thereby freed from direct piston push force transfer. Instead, axially slide able and spring loaded snap pins are employed that engage with corresponding pin receive holes in the drive plates. Release access holes peripherally connect with the pin receive hole for a convenient disengaging of the snap pins and separation of the ratchet cartridge. To reassembly the ratchet cartridge, the snap pins are automatically depressed by pin actuation chamfers while the ratchet cartridge is moved into assembly position. The snap pins snap in as soon as the rod-plate interface comes into mating contact.

Preferably three cartridge pawls are employed and the load transfer between them is balanced out by adjusting the pitch of their plate-pawl interfaces around the torque transfer axis in correspondence with the load deformation of the drive plates, ratchet wheel and cartridge pawls.

A reliable and balanced contact pressure distribution in the pawl-tooth interfaces is achieved by defining a contact angle between the cartridge pawl front faces and the ratchet tooth flanks of the pawl-tooth interfaces such that a gap between the cartridge pawl end face and the ratchet tooth flank increases in direction away from the torque transfer axis while the cartridge pawl end faces are in a load free contact with their mating ratchet tooth flanks. As a result, contact pressures ramp up in the pawl-tooth interfaces starting from closest to the torque transfer axis and peak pressures are kept in the grooves of the ratchet teeth. At the same time a resulting torque on the pawls causes them to be pushed into the ratchet teeth grooves, which effectively prevents inadvertent snapping free of the cartridge pawls under load.

DETAILED DESCRIPTION

Figure 1:
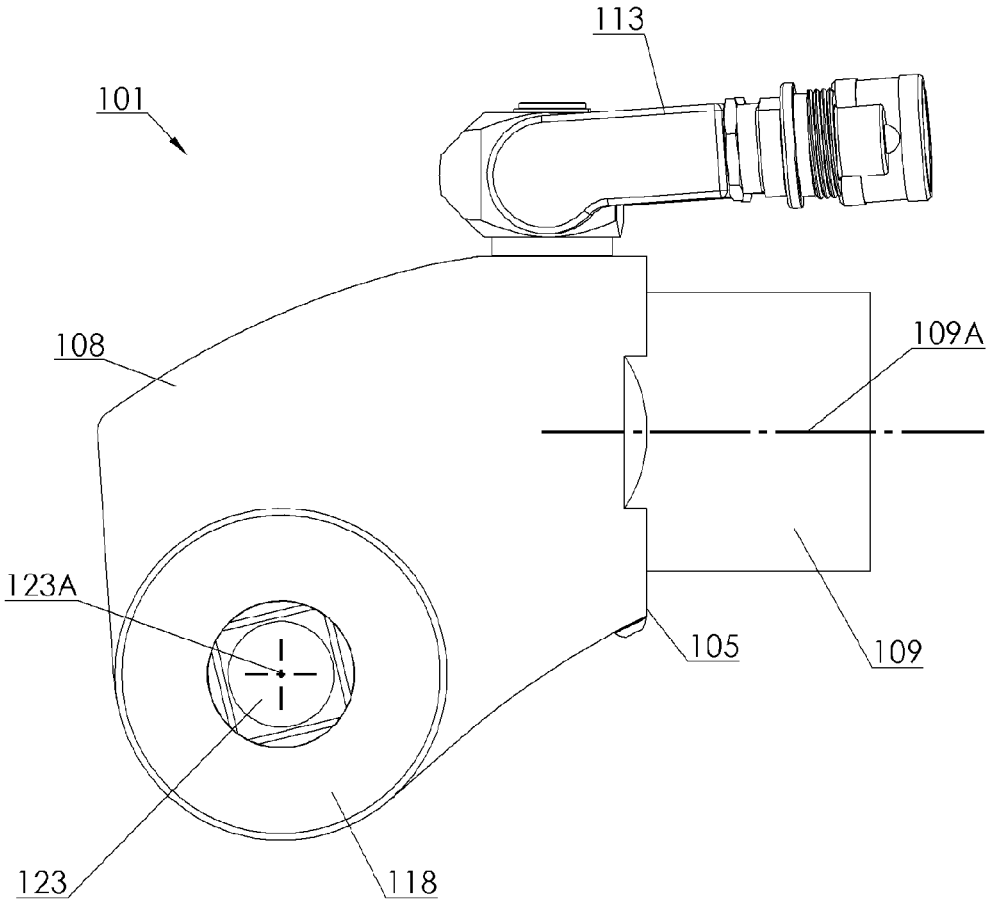
FIG. 1 is a side view of a hydraulic torque wrench of the present invention.

Referring to FIGS. 1, 2, 3, 4, a hydraulic torque wrench 101 has a hydraulic piston 305 that is transforming a hydraulic pressure into a piston force along a piston axis 109A. The pressurized fluid is preferably communicated to and from hydraulic torque wrench 101 via a hose connect swivel 113 peripherally connected to a housing 105. The housing 105 has a cartridge housing 108 with a cartridge cavity 107 that encapsulates a ratchet cartridge 201 and a piston housing 109 that encapsulates a piston assembly 301 including the hydraulic piston 305 and a piston sleeve 308. An attachment flange 118 is preferably around a torque transfer axis 123A at a distal end of the cartridge housing 108. A torque transfer feature 123 is rotate able around the torque transfer axis 123A and may be an external feature extending outside the cartridge housing 108 such as a square stud as shown in the FIGS. 1-3. The torque transfer feature 123 may also be an internal feature residing inside the cartridge housing 108 as is well known in the art.

Figure 5:
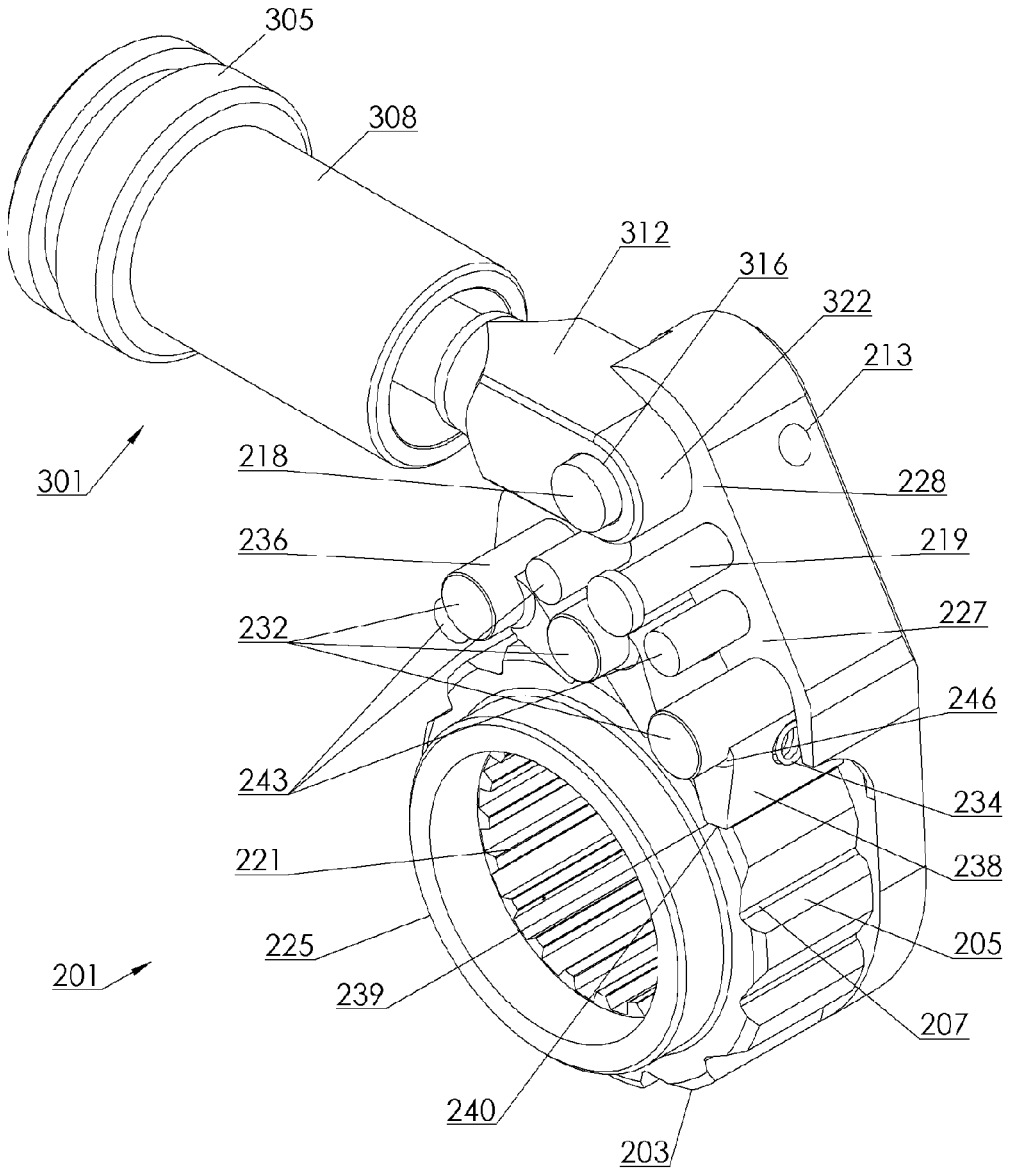
FIG. 5 depicts the content of FIG. 4 without one frontal drive plate.
Figure 6:
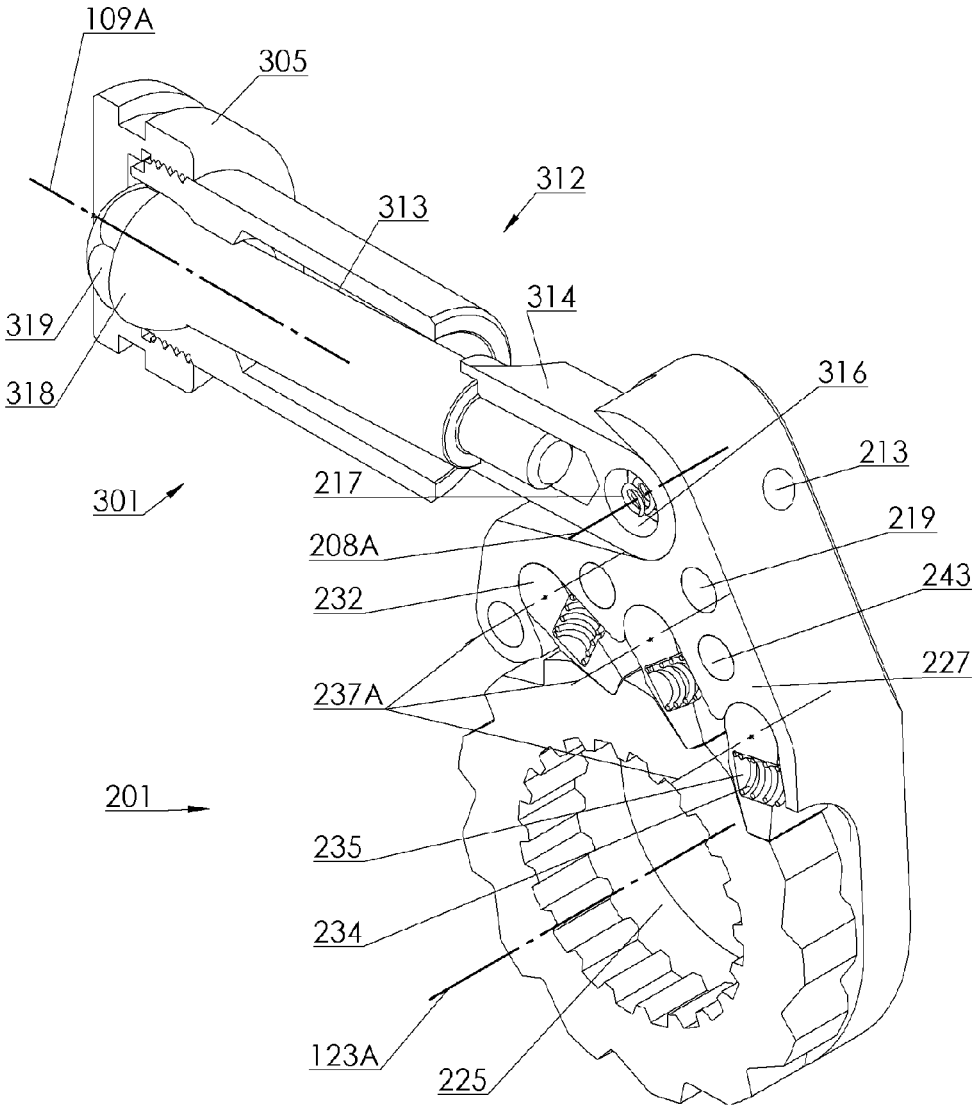
FIG. 6 depicts the content of FIG. 4 cut along a vertical plane.
Figure 8:
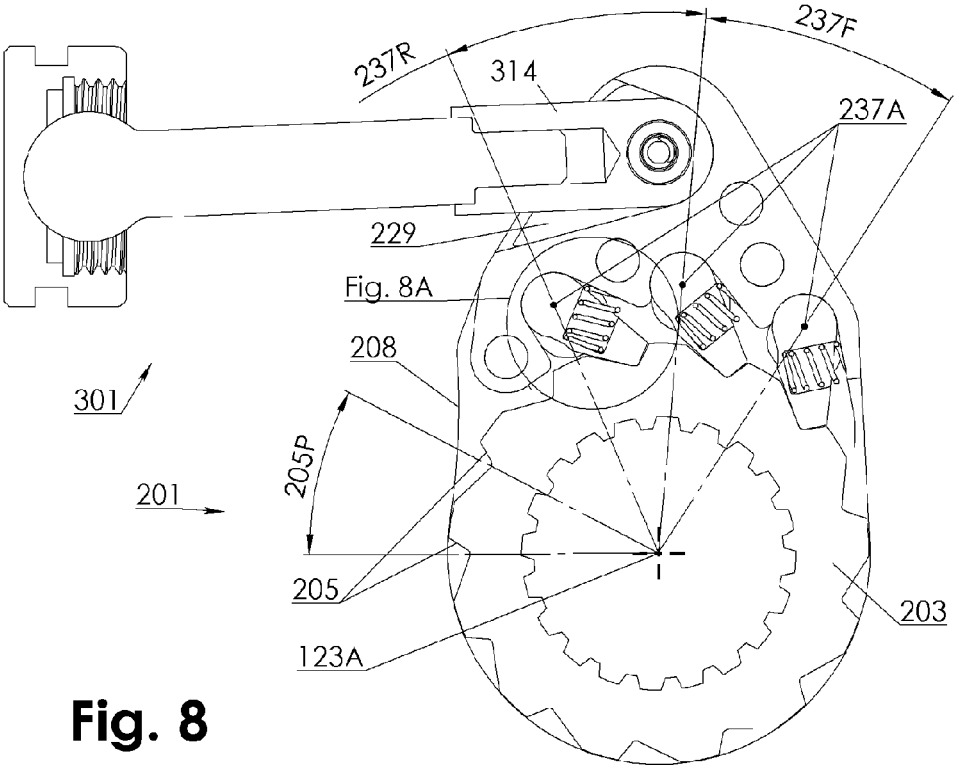
FIG. 8 is a side view of the content of FIG. 6.

As shown also in FIGS. 5, 6, 8, a piston rod 312 is in contact with the hydraulic piston 305 and is receiving the piston force from the hydraulic piston 305. The piston rod 312 has a rod rear 313 that is mating the hydraulic piston at its end and a rod head 314 that has at its end a rod push face 322 and a rod retention hole 313. The rod push face 322 is corresponding to a rod receive face 228 of drive plates 208 that sandwich and partially encompass a ratchet wheel 203. Drive plates 208 and ratchet wheel 203 are part of the ratchet cartridge 201. The rod retention hole 313 is corresponding to snap pin receive holes 216 preferably in both drive plates 208. The rod push face 322, rod receive face 228, rod retention holes 316 and snap pin receive holes 216 are part of a rod-plate interface and are preferably concentric with respect to rod-plate interface axis 208A. The drive plates 208 receive the piston force from the piston rod 312 via the rod-plate interface.

Due to the snap connection between the piston rod 312 and the ratchet cartridge 201, the rod rear 313 and the rod head 314 may be pre assembled through the piston sleeve 308 prior to attachment of the piston sleeve 308 with the hydraulic piston 305. In FIG. 6, the rod rear 313 is shown in uncut view with its spherical rod rear head 318 and a tightening crown 319 with preferred contour of a hex that is radially recessed into the spherical rear head 318. Via the tightening crown 319 the rod rear 313 may be conveniently screwed into and combined with the rod head 314 through the piston sleeve 308. This provides for a rod combine interface between the rod rear 313 and the rod head 314 that does not need to be structurally compromised to accommodate for radial tightening flats as they are well known in the prior art. As a favorable result, the rod combine interface has improved structural strength to transfer the piston force while reducing the risk of buckling. The tightening crown 319 in turn fits in between the piston/rod interface and the rod/sleeve interface without compromising their contact areas.

Part of the ratchet cartridge 201 are also preferably three cartridge pawls 232 that receive the piston force from the drive plates 208 via respective plate-pawl interfaces. The cartridge pawls 232 preferably each feature a cartridge pawl wing 238 and a cartridge pawl shaft 236 that sticks out on both ends. The cartridge pawl wing 238 has a spring blind hole 235. On its distal end it has a cartridge pawl front face 240 and a pawl front edge radius 239. Cartridge pawl springs 234 may be contained in the spring blind holes 235 and push the cartridge pawl wings 238 towards the ratchet wheel 203. Part of each plate-pawl interface is a pawl shaft mating face 237 provided by the drive plates 208 and the cartridge pawl shaft 236. Pawl shaft mating faces 237 and cartridge pawl shafts 236 are concentric with respective plate-pawl interface axes 237A.

The ratchet wheel 203 is rotate able held in the cartridge housing 108 and rotate able held on to by the drive plates 208 concentric with respect to the torque transfer axis 123A. The ratchet wheel 203 is receiving the piston force from the cartridge pawls 232 via a pawl-tooth interface such that the piston force is transformed into a torque around the torque transfer axis 123A. Part of each pawl-tooth interface is a respective pawl front face 240 and pawl front edge radius 239 on the side of the cartridge pawls 232 and a respective one of a number of ratchet tooth flanks 205 and tooth base radii 207 on the side of the ratchet wheel 203. Ratchet tooth flanks 205 and tooth base radii 207 are arrayed around the circumference of the ratchet wheel 203 in a ratchet teeth pitch 205P. Respective pawl front edge radii 239 and tooth base radii 207 are defining pawl-tooth interface axes 207A through which a cartridge force vector 232V passes at the moment the piston force starts to ramp up.

Figure 8A:
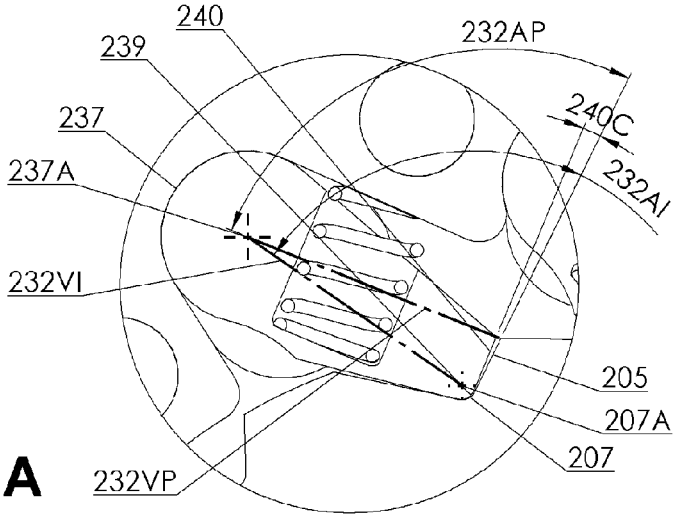
FIG. 8A is a detail view of FIG. 8.

During initial piston force transfer and before elastic deformation occurs in the drive plates 208, the ratchet wheel 203 and the cartridge pawls 232, contact in the pawl-tooth interfaces is substantially only between the respective tooth base radii 207 and pawl front edge radii 239. Consequently and as is clear to anyone skilled in the art, each respective initial force vector 232VI is angularly defined by the position of the respective plate-pawl interface axis 237A and pawl-tooth interface axis 207A within the ratchet cartridge 201 as shown in FIG. 8A. At the same time and while the plate-pawl interfaces are in a substantially load free mating contact, the cartridge pawl front faces 240 and respective ratchet tooth flanks 205 are in a pawl clearance angle 240C such that a gap between them increases in direction away from the torque transfer axis 123A. The initial force vector 232VI is in an initial vector angle 232AI to the respective tooth flank 205 within the ratchet cartridge 201 and within a mating pawl-tooth interface that is substantially less than ninety degrees. Consequently, as the piston force starts, initial piston force transfer in the pawl-tooth interface is across the pawl front edge radii and respective tooth base radii 207 only. Due to the off perpendicular initial vector angle 232AI a resulting initial torque forces the respective cartridge pawl 232 towards the ratchet wheel 203 as is clear to anyone skilled in the art. As the piston force ramps up, deformations occur in drive plates 208, ratchet wheel 203 and cartridge pawls 232 that cause the clearance angle 240C to decrease and contact pressure to extend more and more into the ratchet tooth flanks 205 and pawl front faces 240. The clearance angle 240C is selected in conjunction with the deformation behavior of drive plates 208, ratchet wheel 203 and cartridge pawls 232 and a predetermined maximum of the piston force such that only at the predetermined maximum piston force, contact pressures in the pawl-tooth interfaces reach the circumferential end of the ratchet teeth 205. In that way, the risk of snapping free of the cartridge pawls 232 under peak load due to wear in the pawl-tooth interface is substantially eliminated. In addition, the position of the plate-pawl interface axes 237A within the ratchet cartridge assembly 201 and the tooth angle 205A of the ratchet tooth flanks 205 with respect to the torque transfer axis 123A are selected such that the peak vector angle 232AP remains below ninety degrees. As a result, even during peak piston force transfer, there remains a torque that forces the cartridge pawls 232 towards the ratchet wheel 203. This also effectively opposes inadvertent snapping free of the cartridge pawls 232 during peak piston force transfer. The clearance angle 240C is preferable between 0.5 and 5 degrees.

Preferably both drive plates 208 feature a drive plate base 209 that extends lateral to the ratchet wheel 203 and a drive plate castle 210 that extends within the width of the ratchet wheel 203. The drive plate castles 210 of both drive plates 208 are preferably in direct contact along respective plate mating faces 227 while each of the two drive plates 208 is assembled on one of the two lateral sides of the ratchet wheel 203. The drive plates 208 are connected with dowel pins 243 and a drive plate tensioner 219 such as a well known shoulder screw. The dowel pins 243 and drive plate tensioner 219 extend radially tight within dowel pin holes 244 and tensioner hole 220 through the drive plate castes 210 up to the plate mating faces 227. The radial tight fit up to the plate mating faces 227 provides accurate positioning of the two drive plates 208 with respect to each other within the ratchet cartridge 201 and increases bending stiffness of the two drive plates 208 as is clear to anyone skilled in the art. The stiffened drive plate castles 210 provide for balanced contact pressures in the rod-plate and plate-pawl interfaces that preferably extend within the drive plate castles 210.

The rod-plate interface with its rod push face 322 and a rod receive face 228 is snug contacting the rod push face 322 while the rod-plate interface is in mating contact. As a favorable result, the piston force is directly transferred from the piston rod 312 onto the drive plates 208 across a substantially larger interface area than in prior art pin style rod-plate push force transferring interfaces. This reduces contact pressures and reduces wear. At the same time it gives room for a snap mechanism in the central area around the rod-plate interface axis 208A around which the piston rod 312 is rotate able with respect to the drive plates 208 while the rod-plate interface is in mating contact. The snap mechanism includes preferably two rod snap pins 218 that are axially with respect to the rod-plate interface axis 208A slide able and spring loaded via a snap pin spring 217 within the rod retention hole 316. While the rod-plate interface is in mating contact, the rod retention hole 316 is axially aligned with the snap pin receive holes 216 to axially receive the rod snap pins 218 and lock the rod-plate interface rotate able. The rod-plate interface axis 208A is perpendicular to the piston axis 109A.

Figure 2:
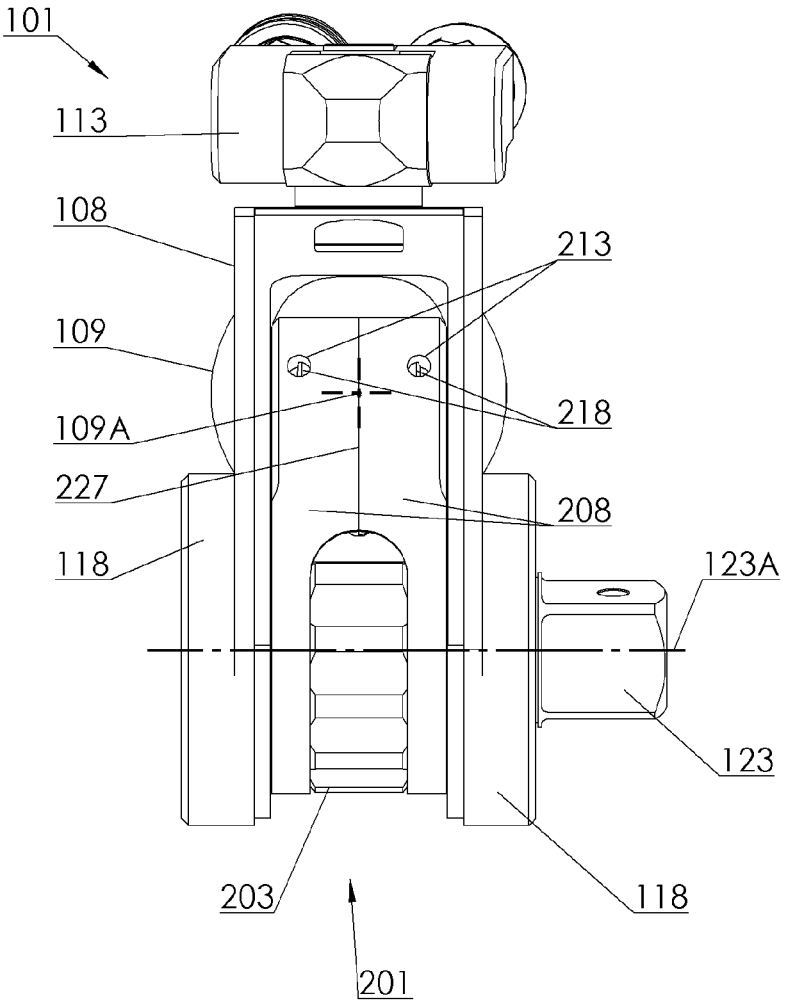
FIG. 2 is a front view of the hydraulic torque wrench of FIG. 1, with a cover shroud removed for visual access to the ratchet cartridge.
Figure 3:
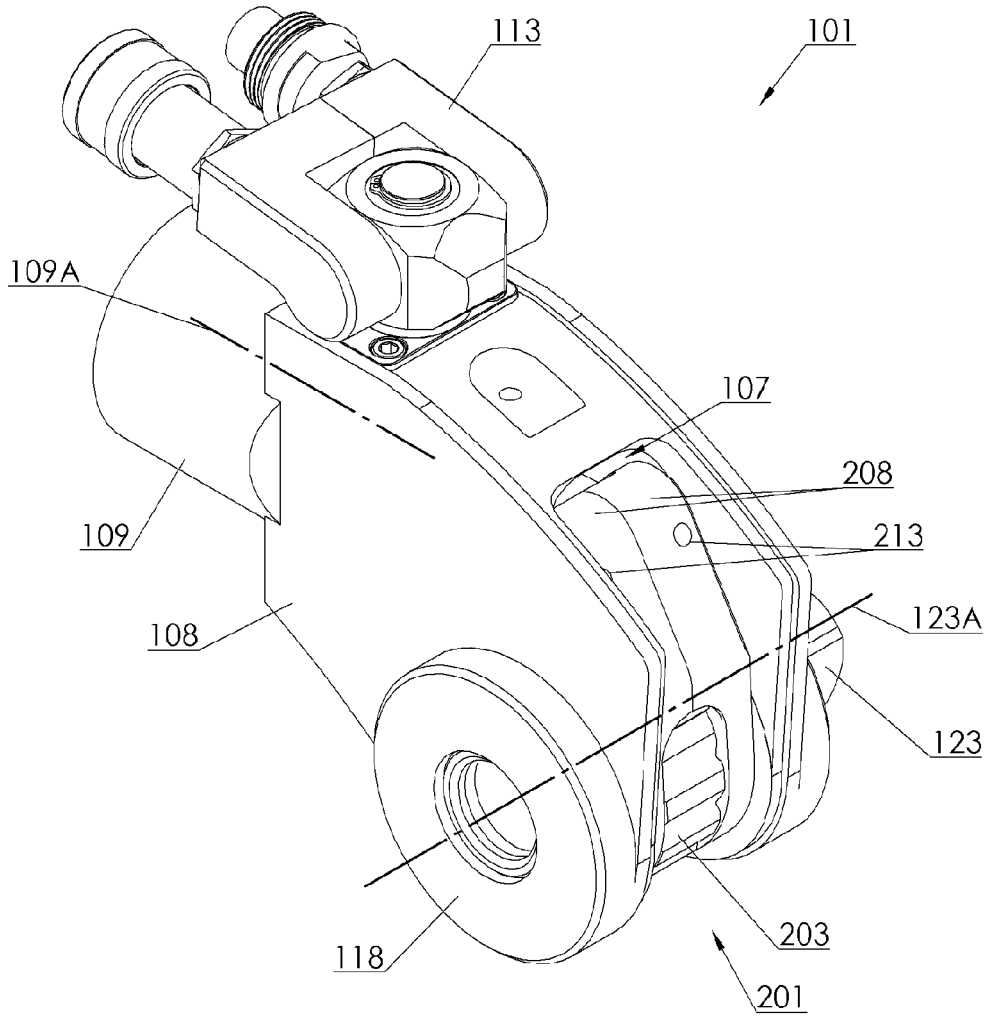
FIG. 3 is a first spatially angled view onto the hydraulic torque wrench of FIG. 2.
Figure 4:
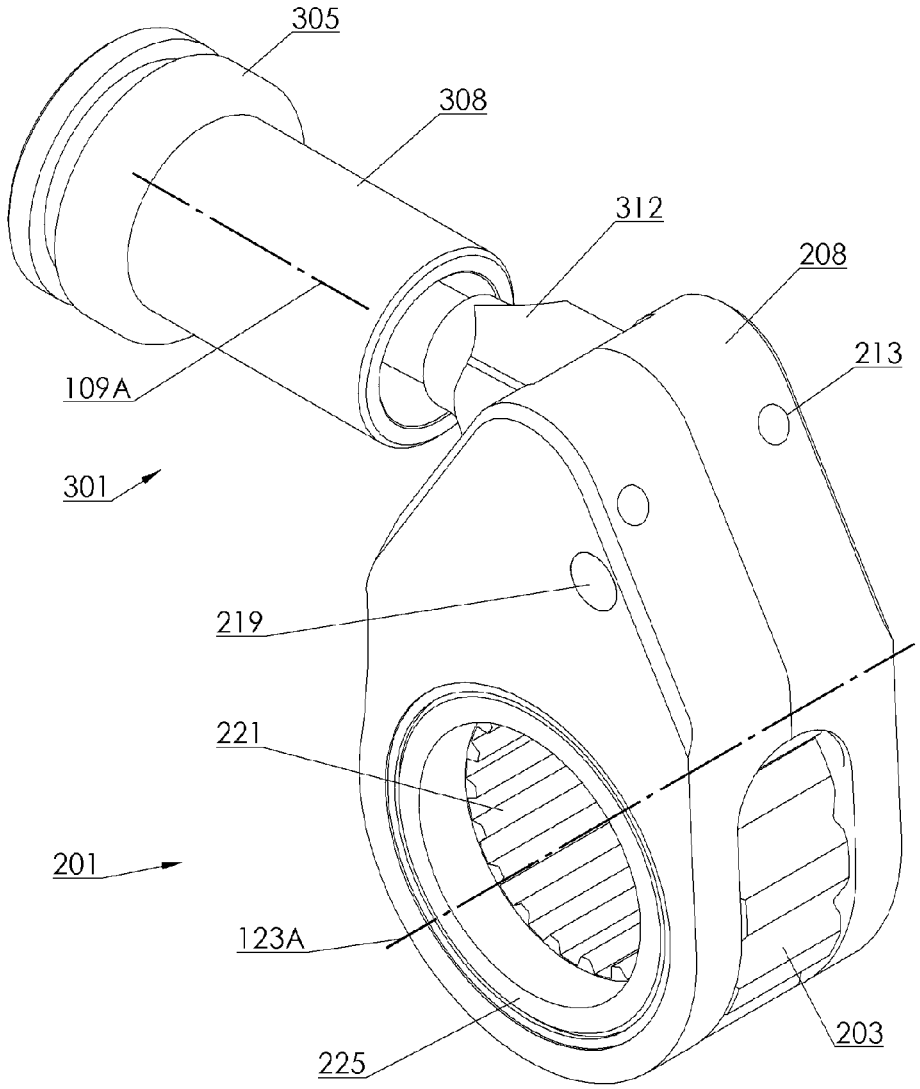
FIG. 4 is the first spatially angled view of the ratchet cartridge and a hydraulic piston assembly of FIG. 3.

Release accesses 213 provide peripheral access across the drive plates 208 to the snap pin receive holes 216. As a result, the snapped in pins 218 may be conveniently peripherally disengaged from the snap pin receive holes 216 via the release accesses 213. The release accesses 213 are preferably blind holes extending approximately perpendicular to the snap pin receive hole 216 across the drive plates 208 for accessing the rod snap pins 218 across the drive plates 208 in a direction substantially aligned with the piston axis 109A. That way, the ratchet cartridge 201 is accessed for disengaging from the piston rod 312 by removing only a well known housing shroud from the cartridge housing 108 as is depicted in FIGS. 2, 3. This greatly simplifies replacement of the ratchet cartridge 201 compared to the prior art. To reconnect the ratchet cartridge 201 with the piston rod 312 within the otherwise assembled hydraulic torque wrench 101, the ratchet cartridge 201 merely needs to be pushed with its rod clearance cutout 229 towards the rod head 314. As the clearance cutout 229 slips over the rod head 314, the laterally extending rod snap pins 218 are depressed against the snap pin spring 217 by the pin actuation chamfers 214 along the peripheral edges of the rod clearance cutout 229.

The cartridge pawls 232 are arrayed with their respective plate-pawl interfaces around the torque transfer axis 123A in front pawl pitch 237F and rear pawl pitch 237R that differ from the ratchet teeth pitch 205P by a pitch difference such that the piston force is evenly transferred across the cartridge pawls 232 in conjunction with the piston force related deformation of the drive plates 208, the ratchet wheel 203 and the cartridge pawls 232. In the preferred embodiment with three employed cartridge pawls 232, the pitch difference may be +/−0.02-1% of the ratchet teeth pitch 205P such that the front pawl pitch 237F is smaller and the rear pawl pitch 237R is larger than the ratchet teeth pitch 205P. Consequently, at the begin of a power stroke when the piston force ramps up from zero while the cartridge pawls 232 are engaged, initially only the middle cartridge pawl 232 transfers the piston force. As the piston force increases and elastic deformation occurs in the drive plates 208, the ratchet wheel 203 and the cartridge pawls 232, front and rear pawl 232 begin to transfer a portion of the piston force as well. As the piston force and deformation peaks, the piston force is evenly balanced out across all three cartridge pawls 232.

Figure 7:
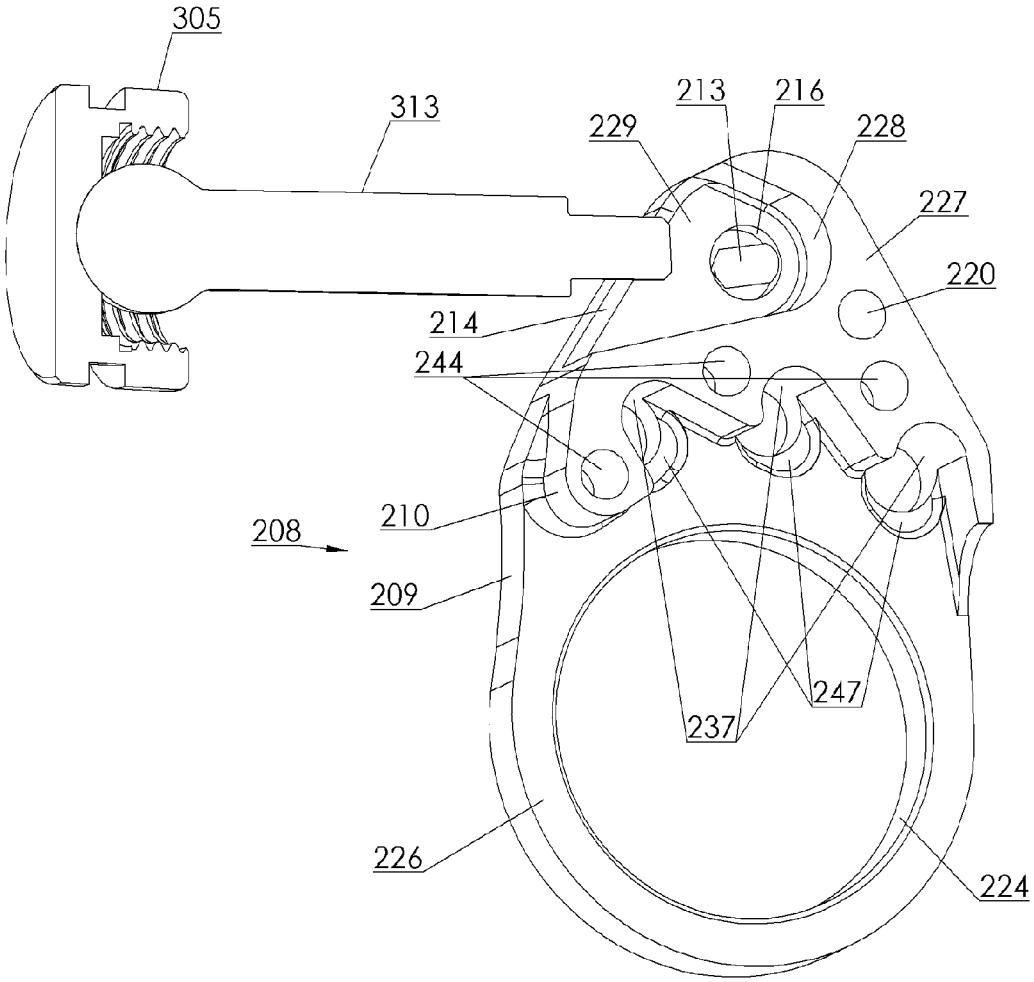
FIG. 7 is a second spatially angled view onto the drive plate and the cut piston and piston rod of FIG. 6.

The piston forces cause bending stresses in the studs of the pawl shafts 236 and substantial stress concentrations in the transition corners between the cartridge pawl wings 238 and the shaft studs extending beyond the cartridge pawl wings 238. A pawl shaft transition radius 246 placed there substantially evens out such stress concentrations. To provide room for these pawl shaft transition radii 246, pawl shaft corner clearances 247 may be recessed into the drive plate bases 209 as shown in FIG. 7.

The drive plates 208 are rotate able holding on to ratchet wheel flanges 225 on both lateral ends of the ratchet wheel 203 via ratchet wheel bushings and ratchet side mating faces 226 as is well known in the art. The ratchet wheel 203 has an internal torque transfer spline 221. In the depicted embodiment with an external torque transfer feature 123 such as a well known square end shaft, the torque transfer spline 221 is engaging with a mating spline of the shaft, which in turn is rotate able held in the cartridge housing 105 as is well known in the art. In an alternate configuration of the claimed hydraulic torque wrench 101 and ratchet cartridge 201 for limited clearance applications, the torque transfer spline 221 may be configured and shaped to mate directly with a nut and/or bolt to be tightened and/or loosened. In that case, the lateral ratchet wheel flanges 225 may axially extend beyond the drive plates 208 for a direct rotate able hold within the attachment flanges 118.

To operate the hydraulic torque wrench 101, it may be connected via the hose connect swivel 113 to well known hydraulic feed and return hoses via which pressurized hydraulic fluid may be communicated to and from the hydraulic piston 305. Upon build up of fluid pressure, the resulting piston force acting on the ratchet cartridge 201 causes the drive plates 208 to rotate around the torque transfer axis 123A. During such power stroke, the cartridge pawls 232 are engaged with ratchet teeth flanks 205 such that the piston force and rotational movement of the drive plates 208 is transferred onto the ratchet wheel 203 and torque is exerted via the torque transfer feature 123. Once the hydraulic piston 305 has reached its travel end it stalls and fluid flow in the hoses needs to be reversed to return the piston back to its most rearward position. During return travel, the snap mechanism returns the drive plates 208 with its disengaged cartridge pawls 232. The ratchet wheel remains in position until the ratchet cartridge 201 is in its most rearward position and the cartridge pawls 232 engage in the next following set of ratchet teeth flanks 205 and the next power stroke is ready to start. In the preferred embodiment of the invention, pawl pitches 237R and 237F are selected such that each of the preferably three cartridge pawls 232 engage with a single ratchet tooth flank 205 to take advantage of the features and their functionality as described in conjunction with FIG. 8.

The compact sizing of the ratchet cartridge 201 provides for increased spacing within the cartridge cavity 107 to accommodate for an automatic hold pawl actuation system as is taught in the cross references application.

Accordingly, the scope of the present invention as described in the above and the Figures is set forth by the following claims and their legal equivalent:

What is claimed is:

1. A hydraulic torque wrench comprising:

A. a housing;

B. a hydraulic piston that is slide able along a piston axis guided in said housing and that is transforming a hydraulic pressure into a piston force along a piston axis;

C. a piston rod that is receiving said piston force from said hydraulic piston;

D. a drive plate that is receiving said piston force from said piston rod via a rod-plate interface, wherein said rod-plate interface further comprises:

A. a rod-plate interface axis around which said piston rod is rotate able with respect to said drive plate while said rod-plate interface is in a mating contact;

B. a rod snap pin that is axially slide able and spring loaded with respect to said rod-plate interface axis;

C. a snap pin receive hole in said drive plate, said snap pin receive hole is axially receiving said rod snap pin while while said rod-plate interface is in mating contact; and D. a release access that provides peripheral access across said drive plate to said snap pin receive hole and while said rod snap pin is snapped in said snap pin receive hole for peripherally disengaging said rod snap pin from said snap pin receive hole.

2. The hydraulic torque wrench of claim 1, wherein said release access is a hole extending approximately perpendicular to said snap pin receive hole for accessing said rod snap pin across said drive plate in a direction that is substantially aligned with said piston axis.

3. A hydraulic torque wrench comprising:

A. a housing;

B. a hydraulic piston that is slide able along a piston axis guided in said housing and that is transforming a hydraulic pressure into a piston force along a piston axis;

C. a piston rod that is receiving said piston force from said hydraulic piston, wherein said piston rod comprises a spherical rod rear head, and wherein said spherical rod rear head comprises a tightening crown that is radially recessed into said spherical rod rear head.

4. A hydraulic torque wrench comprising:

A. a housing;

B. a hydraulic piston that is slide able along a piston axis guided in said housing and that is transforming a hydraulic pressure into a piston force along a piston axis;

C. a piston rod that is receiving said piston force from said hydraulic piston;

D. a drive plate that is receiving said piston force from said piston rod via a rod-plate interface;

E. a cartridge pawl that is receiving said piston force from said drive plate via a plate-pawl interface;

F. a ratchet wheel that is rotate able concentric with respect to a torque transfer axis held in said housing and rotate able held on to by said drive plate and that is receiving said piston force from said cartridge pawl via a pawl-tooth interface such that said piston force is transformed into a torque around said torque transfer axis;

wherein said at least two cartridge pawls are arrayed with their respective plate-pawl interfaces around said torque transfer axis in a pawl pitch that differs from said ratchet teeth pitch by a pitch difference such that said piston force is evenly transferred across said at least two cartridge pawls in conjunction with a piston peak force related deformation of said drive plate, said ratchet wheel and said at least two cartridge pawls.

5. A hydraulic torque wrench comprising:

A. a housing;

B. a hydraulic piston that is slide able along a piston axis guided in said housing and that is transforming a hydraulic pressure into a piston force along a piston axis;

C. a piston rod that is receiving said piston force from said hydraulic piston;

D. a drive plate that is receiving said piston force from said piston rod via a rod-plate interface;

E. a cartridge pawl that is receiving said piston force from said drive plate via a plate-pawl interface;

F. a ratchet wheel that is rotate able concentric with respect to a torque transfer axis held in said housing and rotate able held on to by said drive plate and that is receiving said piston force from said cartridge pawl via a pawl-tooth interface such that said piston force is transformed into a torque around said torque transfer axis;

wherein said plate-pawl interface comprises a cartridge pawl front face and a ratchet tooth flank that is in a pawl clearance angle with respect to said cartridge pawl end face such that a gap between said cartridge pawl front face and said ratchet tooth flank increases in direction away from said torque transfer axis while said plate-pawl interface is in a substantially load free mating contact.

* * * * *